US005562423A

United States Patent [19]

Orth et al.

[11] Patent Number: 5,562,423

[45] Date of Patent: * Oct. 8, 1996

[54] AUTOMATIC FLOAT CONTROL SWITCH FOR A BILGE AND SUMP PUMP

[75] Inventors: Stephen R. Orth, Park Ridge; Burton L. Siegal, Skokie, both of Ill.

[73] Assignee: Johnson Pumps of America, Inc., Schiller Park, Ill.

[ * ] Notice: The portion of the term of this patent subsequent to Mar. 29, 2011, has been disclaimed.

[21] Appl. No.: 323,863

[22] Filed: Oct. 17, 1994

[51] Int. Cl.[6] ..... F04B 49/04

[52] U.S. Cl. ..... 417/40; 200/84 C

[58] Field of Search ..... 417/40, 38; 200/84 C; 29/622

[56] References Cited

U.S. PATENT DOCUMENTS

| | | | |
|---|---|---|---|
| Des. 306,447 | 3/1990 | Whitley, II . | |
| 2,844,678 | 7/1958 | Nielesen . | |
| 3,316,845 | 5/1967 | Schumann . | |
| 3,684,400 | 8/1972 | Einerson et al. | 417/40 |
| 3,999,890 | 12/1976 | Niedermeyer . | |
| 4,165,204 | 8/1979 | Nielsen . | |
| 4,186,419 | 1/1980 | Sims . | |
| 4,275,995 | 6/1981 | Taylor . | |
| 4,345,879 | 8/1982 | Steiner . | |
| 4,805,066 | 2/1989 | Mergenthaler . | |
| 4,917,135 | 4/1990 | Duncan . | |
| 4,941,806 | 7/1990 | Brown et al. . | |
| 4,972,709 | 11/1990 | Bailey, Jr. et al. | 417/38 |
| 5,025,827 | 6/1991 | Weng . | |
| 5,155,311 | 10/1992 | Utke | 417/40 |
| 5,297,939 | 3/1994 | Orth et al. | 417/40 |

*Primary Examiner*—Timothy S. Thorpe
*Assistant Examiner*—Xuan M. Thai
*Attorney, Agent, or Firm*—Hill, Steadman & Simpson

[57] ABSTRACT

An automatic control for a liquid pump which assures that the pump starts when the liquid reaches a predetermined level and that the pump is stopped when the level has fallen to a second predetermined level. The control includes a permanent magnet mounted in a float which is contained within a float chamber and which has a bottom opening through which liquid can enter the float chamber. A top portion of the float chamber is provided with a one-way valve which allows air to escape from the float chamber but which prevents air from entering the float chamber so that when the float moves up with the liquid, the magnet actuates a magnetic responsive switch such as a reed switch to cause the motor to drive the pump. As the pump lowers the level of the liquid, the level of the liquid in the float chamber does not fall because of the partial vacuum within the top of the float chamber and the magnetic holds the switch closed so as to maintain energization of the pump. When the liquid falls to the bottom of the float chamber, air passes into the top of the chamber and allows the retained liquid to flow, and the float moves downwardly moving the magnet away from the magnetic responsive switch so that it opens and the pump motor stops. The float chamber and the magnetic responsive switch are remotely located from the pump.

4 Claims, 2 Drawing Sheets

AUTOMATIC FLOAT CONTROL SWITCH FOR A BILGE AND SUMP PUMP

BACKGROUND OF THE INVENTION

1. Field of the Invention

This invention relates in general to an automatic control for bilge and sump pumps and in particular to a magnetically actuated float switch for controlling a pump.

2. Description of Related Art

This invention is an improvement on our U.S. Pat. No. 5,297,939 entitled "Automatic Control For Bilge And Sump Pump" which related to the combination of a bilge or sump pump which has a motor mounted in a sealed pump housing and a separate switch housing with a float chamber that communicates with the pump inlet. A magnet is mounted in a float and moves up in the float chamber as the level of the fluid rises. At the top of the float chamber, a one-way valve is mounted so as the liquid level rises, air can pass out the one-way valve so that the water level will rise to allow the magnet to energize a reed switch to start the motor. As the motor starts to pump the water, the water level falls. However, due to the one-way valve in the float chamber, the liquid level in the float chamber does not fall with the level of the water until the liquid level has reached the bottom of the float chamber, at which time air can enter the float chamber and the liquid then passes out of the float chamber, thus allowing the float to move downwardly deactuating the switch. The level in the float chamber remains higher than the liquid level being pumped because of the partial vacuum that is formed in the float chamber above the float which holds the internal liquid above the external liquid level. See also the references cited in our copending patent application Ser. No. 5,297,939.

SUMMARY OF THE INVENTION

The present invention relates to a float switch which is not physically directly attached to the motor housing as in U.S. Pat. No. 5,297,939. In the present invention, the float switch and the motor which drives the pump comprises separate units and are physically separated from each other. The magnetic float switch of the present invention has two chambers, one in which a magnetically responsive reed switch is mounted and the other chamber comprises a float chamber into which water is received so that as the water rises, the float rises in the float chamber. A magnet is carried by the float, which actuates the reed switch when the float reaches a predetermined level in the float chamber. The float chamber is provided with a one-way valve in its top, such that as the float rises in the fluid chamber, air can pass out of the float chamber but when the water level falls, the float will be held by partial vacuum above the float until the water level falls to a point adjacent the bottom of the float chamber at which time the water can then flow out of the float chamber so as to allow the float to drop to deactuate the switch and turn off the motor.

It is seen that this invention comprises a novel magnetically operated switch, which is actuated by a float in a float chamber that includes a one-way valve to allow air to escape therefrom and wherein the switch is separated from the pump.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 1:
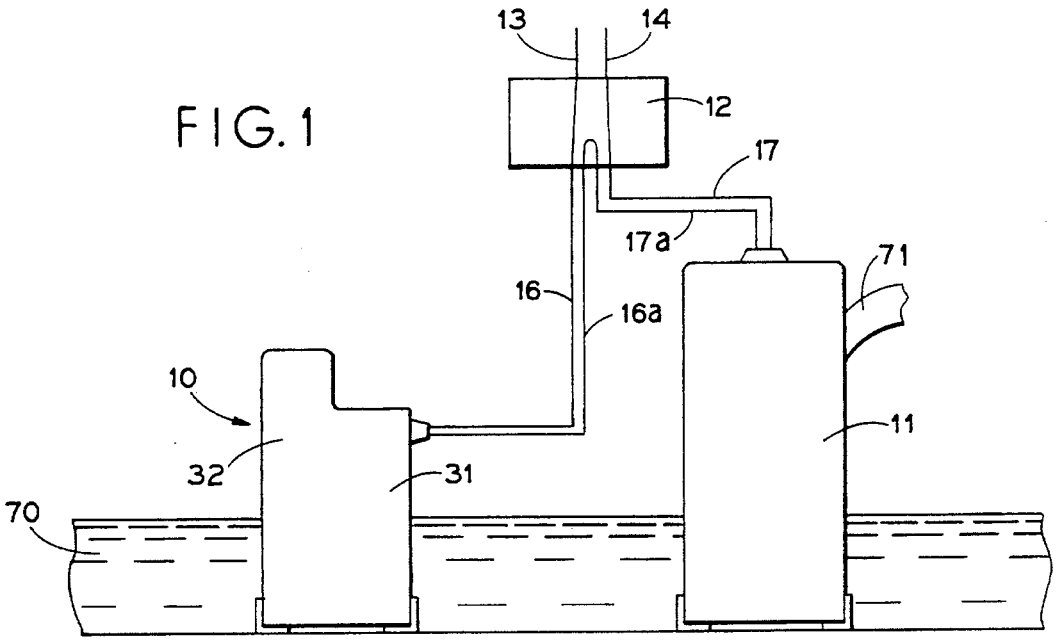
FIG. 1 is a side plan view illustrating the magnetically controlled float switch of the invention connected in circuit with a pump.
Figure 2:
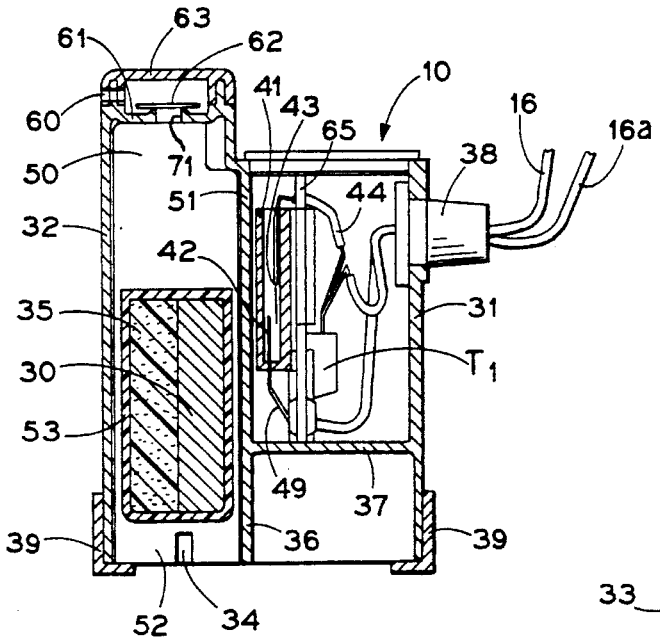
FIG. 2 is a sectional view through the magnetically actuated float switch.
Figure 3:
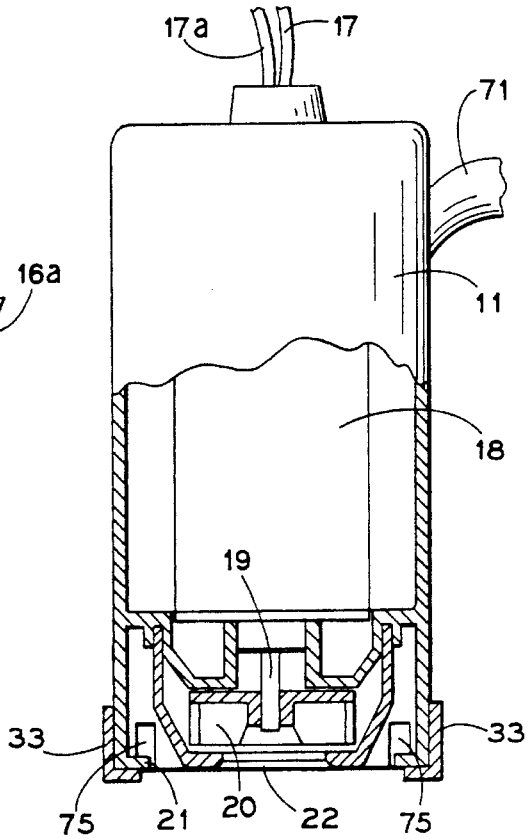
FIG. 3 is a cut-away side view of the motor.
Figure 5:
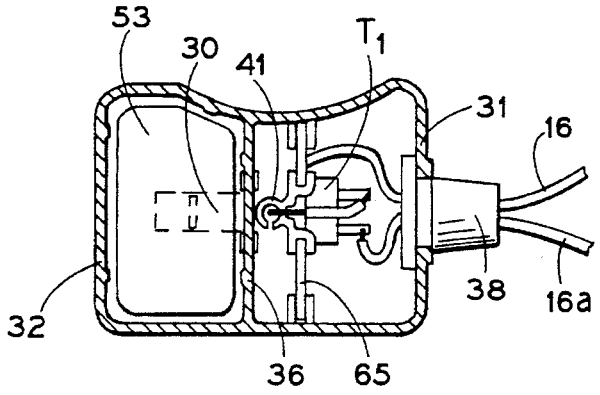
FIG. 5 is a horizontal sectional view of the magnetically actuated float switch.
Figure 4:
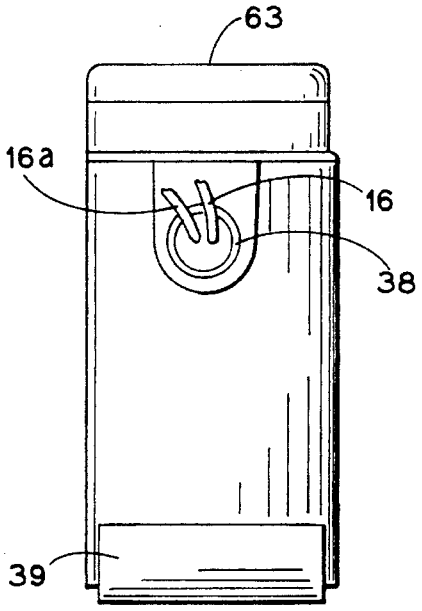
FIG. 4 is a side view of the float switch.

FIG. 1 illustrates a pump 11 which as shown in FIG. 3 includes a motor 18 that has an output shaft 19 that drives an impeller 20 that is mounted in a pump housing that has a chamber 22 of a base 21 into which liquid such as water can enter. The pump 11 has a fluid outlet 71. Slots 75 are formed in the base so that water can pass to the impeller 20. A ring 33 surrounds base 21. Leads 17 and **17*a* are connected to a junction box 12. One lead of a power supply 14 is connected to lead 17 in the junction box 12 and the other lead 17*a* is connected to a lead 16*a* which connects to the float switch 10 of the invention. Power supply lead 13 is connected to float switch lead 16. Float switch 10 has a float chamber 32 and a switch chamber 31 and rests on a base 39 as illustrated in FIGS. 2, 4 and 5**. These elements are mounted in a switch housing.

The float chamber 32 is similar to the float chamber described in U.S. Pat. No. 5,297,939 and includes a float 53 in which is mounted a permanent magnet 30. The remaining portion of the float 53 is filled with foam material 35. The float 53 can move up and down in the float chamber 32 as liquid enters slots 34 in the base 39. As the float 53 moves up in the float chamber 32, air in the upper portion 50 of the float chamber 32 passes out a one-way valve 62 mounted in a cover 61 of the float chamber 32. An opening 60 allows the air to escape through the side wall of a cover member 63 above the one-way valve 62. The switch chamber 31 is liquid sealed and separated by partition walls 36, 37 and 51 from the float chamber 32 and a heat seal wall 65 in the switch chamber 31 supports a reed-type switch 41 which has normally open contacts 42 and 43 that are closed when the float 53 moves sufficiently upwardly in the float chamber 32 so that the magnet can close the contacts 41 and 43. A transistor T1 is connected to the reed switch 41 and thus lead 16 and **16*a* are connected to the transistor T1 and switch 41. Finally, lead 16 is connected to the transistor $T_1$ as shown in the electrical schematic of FIG. 6**.

In U.S. Pat. No. 5,297,939, the float valve and switch housing were connected to the housing of the pump 11 and in the present invention, the float chamber 32 and switch chamber 31 are physically separated from the motor housing 11 as illustrated in FIG. 1. The pump 11 is mounted so that its bottom engages the bottom of a boat or other chamber which is to be emptied, and when water 70 enters the slots 34 of the switch 10, the float 53 will move up in the float chamber 32 forcing air out of the chamber 50 above the float 53 through the one-way valve 62 and opening 60. When the permanent magnet 30 in the float 53 moves up so that it is adjacent the open switch contacts 42 and 43 of the reed switch 41, the switch will close causing the transistor $T_1$ to supply power to the motor 18 of the pump 11 so that the pump is actuated to discharge water through its discharge conduit 71. As the pump 11 removes the water 70 from the bottom of the boat, the float 53 remains in an upper portion of the float chamber 32 due to a partial vacuum which exists in the chamber 50 of the float chamber 32 because the one-way valve 62 does not allow air to enter the upper chamber 50 as the water level is lowered by the pump. The one-way valve 62 may be a soft elastomeric flapper cooperating with a valve seat 71. When the water level reaches the top of the water inlet slots 34, air can then enter through the slots 34 into the lower portion 52 of the float chamber and air will pass up into the upper chamber 50 of the float chamber, thus breaking the partial vacuum so that the float 53 will then move downwardly in the float chamber 32 so that the magnet 30 is no longer adjacent the reed switch 41 and the reed switch will open which breaks the circuit to the pump motor 18. This stops the pump after substantially all of the water has been removed from the boat, (or other chamber). Electrical leads 16 and **16*a* pass into float switch 10**.

Figure 6:
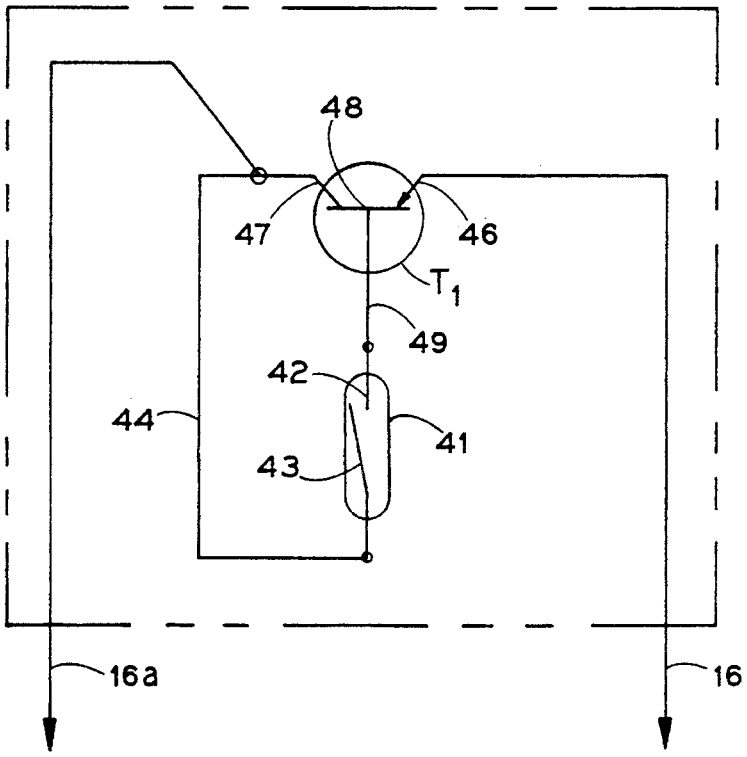
FIG. 6 is an electrical schematic of the float switch of the invention.

FIG. 6 illustrates the reed switch 41 which has the contact 42 connected to a lead 49 that is connected to the base 48 of the transistor $T_1$, which may be mounted on a heat sink. The emitter 46 of the transistor is connected to lead 16 and the contact 43 of the reed switch 41 is connected to a lead 44 which is connected to lead **16*a* and to the collector 47 of the transistor T1. Thus, when the contacts 42 and 43 are engaged by the permanent magnet 30, the transistor T1 will be biased into conduction so that current can flow from lead 16 to 16*a* through the emitter-collector path of the transistor T1 so as to energize the motor 18**.

It seen that this invention provides a novel float switch that can be located remotely from the pump 11 so as to control the operation of the pump.

Although it has been described with respect to preferred embodiments, it is not to be so limited as changes and modifications can be made therein which are within the full intended scope as defined by the appended claims.

We claim as our invention:

1. A magnetic float switch for a pump, mounted in a pump housing, comprising: a switch housing with a float chamber, a float movably mounted in said float chamber, a magnet mounted in said float, a magnetic responsive switch mounted in said switch housing adjacent said float chamber so that it can be actuated by said magnet as said float moves in said float chamber, a one-way valve mounted in an upper portion of said float chamber so as to allow air to pass out of the float chamber as the liquid level in the float chamber rises, but which prevents air from entering the float chamber as the liquid level outside the float chamber falls, said float chamber's lower portion having an opening to receive and discharge liquid, said magnetic responsive switch electrically connected to said pump to actuate it, and said pump housing and said switch housing separated from each other.

2. A magnetic float switch for a pump according to claim 1 wherein said magnetic responsive switch is mounted in said housing in a chamber which is separated and liquid sealed from said float chamber.

3. A magnetic float switch for a pump according to claim 1 wherein the bottom of said float chamber is formed with at least one inlet slot to allow liquid and air to enter said float chamber.

4. A magnetic float switch according to claim 1 including a power transistor connected between said magnetic responsive switch and said pump.

* * * * *